US006945046B2

(12) United States Patent
Allmang et al.

(10) Patent No.: US 6,945,046 B2
(45) Date of Patent: Sep. 20, 2005

(54) TURBINE CASING FOR AN EXHAUST TURBOCHARGER MADE BY CASTING

(75) Inventors: Ruediger Allmang, St. Julian (DE); Hartmut Claus, Grunstadt (DE); Volker Simon, Landau (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/296,135

(22) PCT Filed: Jun. 6, 2001

(86) PCT No.: PCT/US01/18274

§ 371 (c)(1),
(2), (4) Date: Nov. 21, 2002

(87) PCT Pub. No.: WO01/94755

PCT Pub. Date: Dec. 13, 2001

(65) Prior Publication Data

US 2003/0205047 A1 Nov. 6, 2003

(51) Int. Cl.[7] ..... F01D 1/02; F01D 9/02; F01D 25/24; F02B 39/00; F02D 23/00

(52) U.S. Cl. ..... 60/602; 60/605.1; 415/136; 415/138; 415/184; 415/200; 415/205; 415/215.1; 415/915; 417/407

(58) Field of Search ..... 60/602, 605.1; 415/136, 138, 184, 204, 205, 200, 203, 206, 213.1, 215.1, 915; 417/407

(56) References Cited

U.S. PATENT DOCUMENTS 3,310,940 A * 3/1967 Oetliker ..... 60/804
3,396,906 A * 8/1968 Newton ..... 415/204
4,147,467 A * 4/1979 Leicht et al. ..... 417/407
4,384,821 A * 5/1983 Mains et al. ..... 415/205
4,927,336 A * 5/1990 Rossmann et al. ..... 417/407
5,810,556 A * 9/1998 Northam et al. ..... 415/200
5,947,682 A * 9/1999 Moon ..... 415/200

FOREIGN PATENT DOCUMENTS

GB 1199158 A * 7/1970 ..... F01D/9/02
GB 1263932 A * 2/1972 ..... F01D/25/24

* cited by examiner

*Primary Examiner*—Sheldon J Richter
(74) *Attorney, Agent, or Firm*—Pendorf & Cutliff; Greg Dziegielewski

(57) ABSTRACT

The invention concerns a casing aggregate for the turbine of an exhaust turbocharger.

The invention is identified by the following characteristics:

a spiral casing adapted for surround the running wheel of the turbine;

a tongue-like wall part (tongue) in the inside of the spiral casing;

an inlet connection;

an outlet connection;

a flange to connect to a bearing casing;

wherein the casing aggregate is manufactured of thin-walled precision casting;

wherein the casing aggregate is made of at least two parts, so that at least one separation joint is present; and the separation joint is arranged as follows:

it runs in an axially perpendicular level;

it runs along the apex line of the spiral casing;

it extends over an arc of a circle of approximately 270 degrees;

it lies outside of the area of the tongue.

2 Claims, 2 Drawing Sheets

TURBINE CASING FOR AN EXHAUST TURBOCHARGER MADE BY CASTING

CROSS REFERENCE TO RELATED APPLICATION

This application is a national stage of PCT/US01/18274 filed Jun. 6, 2001 and based upon DE 100 28 161.3 filed Jun. 7, 2000 under the International Convention.

The invention concerns a casing aggregate for the turbine of an exhaust turbocharger. The invention especially concerns the spiral casing of the turbine.

Exhaust turbochargers are a must in modern vehicles. The most important components include a turbine and a compressor. These two components are located on one and the same shaft. The exhaust of the internal combustion engine is conducted to the turbine. The exhaust powers the turbine. Then the turbine in turn powers the compressor. This takes in air from the environment and compresses it. The compressed air is then used for combustion in the engine. The purpose of exhaust turbochargers is to minimize the exhaust emissions as well as to increase the efficiency of the engine and its torque. They also have an important function in regards to the efficiency of the catalytic converter.

The following requirements are generally demanded of an exhaust turbocharger: They should fulfill the mentioned functions regarding the exhaust emission, the efficiency level and torque of the engine in the most optimal manner possible. In doing so, they should have minimal weight and minimal construction volume. The design should be simple and easy to assemble, so that manufacturing costs are held to minimal levels. They should be compatible with catalytic converters.

The known exhaust turbochargers do not fill all these functions, or only to a certain point. That is, lowering pollutant emissions during the cold start phase leaves much to be desired, and weight and space demands are unreasonably high.

The task of the invention is to design a casing aggregate of the type mentioned in such a manner that significant improvements are made in the mentioned parameters. This task is accomplished by the characteristics of claim 1.

In accomplishing the task, the inventors stuck with the tried and true execution of the casing aggregate by casting. For this, however, they departed from the conventional method of casting steel in a sand mold, and switched to a thin-walled fine casting, also known as precision casting. This allows the wall thickness to be greatly reduced. This also greatly decreases the weight of the aggregate. The casing aggregate now has a substantially lower mass, so that only relativey small heat energy can be removed from the exhaust in the cold start phase. Thus the thermal inertia is very minimal.

As an additional measure, the casing aggregate is assembled from at least two parts. Therefore, the casing aggregate has at least one separation joint. The separation joint is arranged as follows:

it extends in an axially perpendicular level, it runs along the apex line of the spiral casing, it extends over an arc of a circle of approximately 270 degrees, and it lies outside of the area of the tongue.

Thus in any case, the spiral casing is in at least two parts. In doing so, the division into two on the basis of the separation joint described above, occurs in such a manner that the two following benefits result:

For one thing, each of the two parts of the spiral casing can be cast without requiring the use of casting cores. The shapes of the two spiral casing parts don't require any undercutting.

In addition, the separation joint is positioned in such a manner that the area of the tongue lies outside of the separation joint. The tongue area is that area this is thermally stressed the most. When the two cast parts of the spiral casing are put together, the tongue area, therefore, consists of a single piece without separation joint, which takes into account the high thermal stress and, therefore, the high demands of rigidity in this area.

The two parts can be joined, for example, using any type of welding, for example using laser welding or microplasma welding.

By avoiding casting cores, positional tolerances don't need to be considered while casting. This means that the wall thickness can already be less for this reason than with the classical method of using casting cores. This already results in considerable weight reduction. A multiple-part turbine casing cast in precision casting has an average wall thickness of approximately 2 mm. This means a-mass reduction of 40 to 60% in comparison to execution in cast steel in sand. In addition, the manufacturing costs of a spiral casing based on the invention are lower than before. In general, a heat resistant cast steel for exhaust temperatures of 1050° C. is considered suitable as a material.

The finish and dimensional accuracy are optimal. This leads to higher efficiency levels. The manufacturing costs will already be lower because refinishing is unnecessary.

The invention is further explained in the drawings. The following details are represented:

Figure 1:
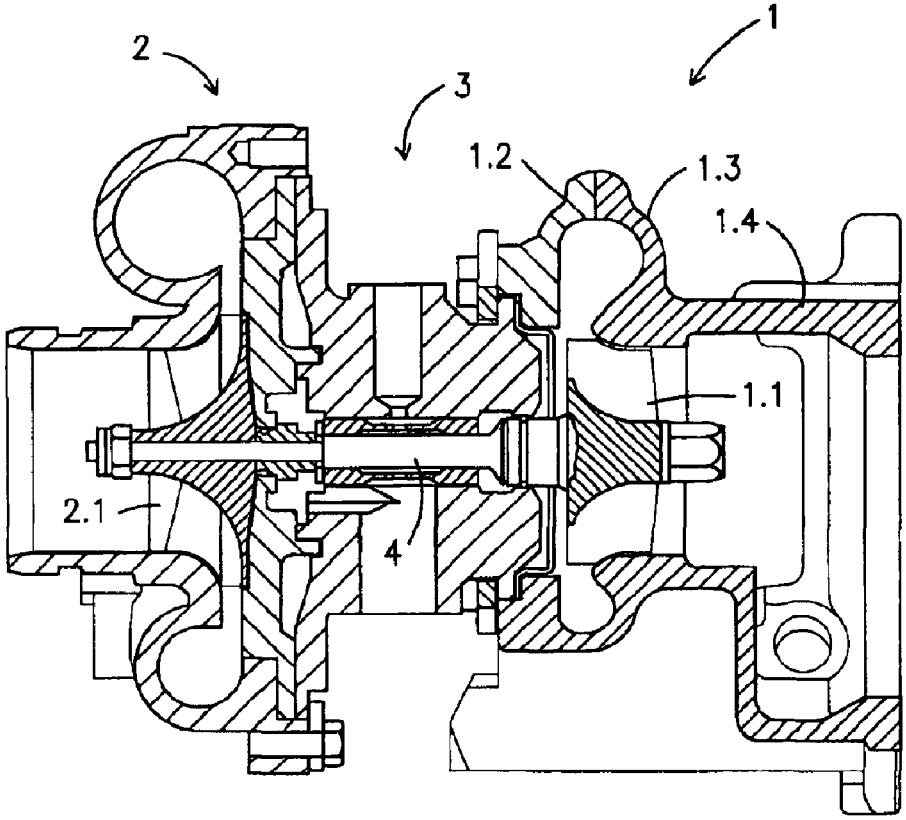
FIG. 1 shows an exhaust turbocharger in axial section.

The turbocharger shown in FIG. 1 has the following components as its most important elements:

A turbine 1 with turbine wheel 1.1, a compressor 2 with compressor wheel 2.1, a bearing 3, and a shaft 4 on which the turbine wheel 1.1 and the compressor wheel 2.1 are seated.

The turbine casing is executed in known fashion as a spiral casing. It is made of two main parts, namely a part 1.2—herein referred to as the "inner part", and a part 1.3—herein referred to as the "outer part". An outer exhaust support 1.4 is a component of the outer part 1.3. This could however also be separate from the outer part 1.3.

The following is decisive:

The two main parts 1.2 and 1.3 of the spiral casing of the turbine are separated along a separation joint. The separation joint runs in an axially perpendicular level. It runs along the apex line of the spiral casing.

Figure 2:
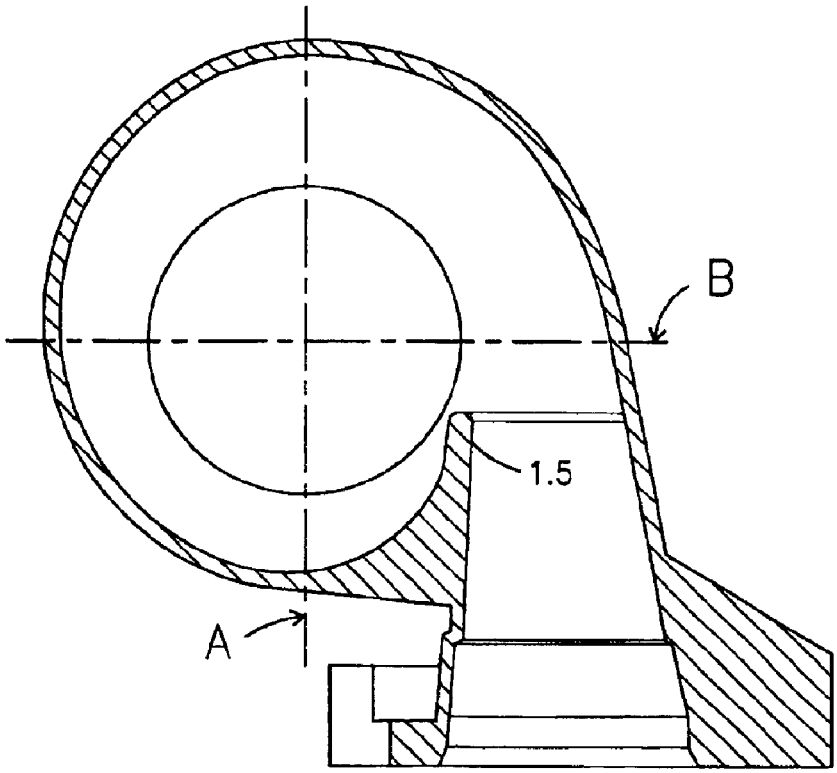
FIG. 2 shows an enlarged section through the spiral casing of the turbine of FIG. 1.

As can be seen in FIG. 2, the separation joint extends over an angle of 270 degrees. It lies outside of the tongue area 1.5 of the spiral casing. This area is highly thermally stressed.

FIG. 2 shows part 1.3. Part 1.2 is removed.

The separation joint extends from point A to point B. The area of the tongue 1.5 remains undisturbed. This means that the spiral casing is one part in the tongue area. For the purpose of assembly, part 1.2 is seated over the area of the separation joint between point A and B on part 1.3.

What is claimed is:

1. Casing aggregate for the turbine of an exhaust turbocharger, comprising:

a. a spiral casing adapted to surround the running wheel of the turbine;

b. a tongue-like wall part (tongue) in the inside of the spiral casing;

c. an inlet connection;

d. an outlet connection;

e. a flange adapted for connecting to a bearing casing of the turbocharger;

f. wherein the casing aggregate is manufactured by thin-walled precision casting;

g. wherein the casing aggregate is comprised of at least two parts, so that at least one separation joint is present; and h. wherein the separation joint is arranged as follows:

i. it runs in an axially perpendicular level;

ii. it runs along the apex line of the spiral casing;

iii. it extends over an arc of a circle of approximately 270 degrees;

iv. it lies outside of the area of the tongue.

2. Casing aggregate as in claim 1, wherein the parts of the casing aggregate are welded to each other along the separation joint.

* * * * *